US009752308B2

(12) United States Patent
Zavala

(10) Patent No.: US 9,752,308 B2
(45) Date of Patent: Sep. 5, 2017

(54) PLUNGER FOR PLUMBING FIXTURES

(71) Applicant: Joey Zavala, Sandpoint, ID (US)

(72) Inventor: Joey Zavala, Sandpoint, ID (US)

(73) Assignee: Joey Zavala, Sandpoint, ID (US)

( * ) Notice: Subject to any disclaimer, the term of this patent is extended or adjusted under 35 U.S.C. 154(b) by 0 days.

(21) Appl. No.: 15/096,154

(22) Filed: Apr. 11, 2016

(65) Prior Publication Data

US 2016/0298322 A1 Oct. 13, 2016

Related U.S. Application Data

(60) Provisional application No. 62/146,540, filed on Apr. 13, 2015.

(51) Int. Cl.
*E03D 11/00* (2006.01)
*E03C 1/308* (2006.01)

(52) U.S. Cl.
CPC ..... *E03C 1/308* (2013.01); *E03D 11/00* (2013.01)

(58) Field of Classification Search
CPC ..... E03C 1/308
USPC ..... 4/255.01–255.12
See application file for complete search history.

(56) References Cited

U.S. PATENT DOCUMENTS 115,768 A * 6/1871 Pagett ..... E05F 5/027 292/79
2,844,826 A * 7/1958 Cheiten ..... E03C 1/308 4/255.11
D292,631 S * 11/1987 Tash ..... E03C 1/308 D32/14
4,745,641 A * 5/1988 Tash ..... E03C 1/308 4/255.11
4,768,237 A * 9/1988 Torti ..... E03C 1/308 4/255.05
5,456,356 A * 10/1995 Kurzawa ..... A47K 10/22 206/225
5,537,694 A * 7/1996 Davenport ..... B08B 9/0322 4/255.05
D381,146 S * 7/1997 Tash ..... A47B 81/02 D32/35
D385,073 S * 10/1997 Tash ..... A47B 81/02 D32/35
5,927,492 A * 7/1999 Moore ..... A47B 81/02 206/349

(Continued)

OTHER PUBLICATIONS

Steve Culpepper, Fine Homebuilding Magazine, Oct. 1, 1997.

*Primary Examiner* — Lori Baker
(74) *Attorney, Agent, or Firm* — Randall Danskin P.S.

(57) ABSTRACT

An improved plunger having a true arch configuration and defining an interior cavity provides a body having a convexly dome shaped upper portion and a rectilinear truncated conic shaped bottom portion that defines a bottom orifice. Axial downward pressure exerted or a handle communicating with a handle attachment carried by the dome shaped upper portion causes the body to collapse to forcefully expel contents of the interior cavity outwardly through the bottom orifice and into a pipe or plumbing fixture. A flexible resiliently deformable exterior lip circumscribing the bottom orifice prevents leakage and the truncated conic shape of the bottom portion fluidically seals a toilet siphon jet to prevent loss of plunger pressure when removing clogs and obstructions.

3 Claims, 12 Drawing Sheets

(56) References Cited

U.S. PATENT DOCUMENTS 6,055,680 A * 5/2000 Tolbert ..... E03C 1/308 4/255.11
6,145,135 A * 11/2000 Pool ..... E03C 1/308 4/255.09
6,163,895 A * 12/2000 Davenport ..... B08B 9/0322 137/536
6,192,525 B1 * 2/2001 Tash ..... E03C 1/308 4/255.11
6,216,283 B1 * 4/2001 Tash ..... A61K 31/51 4/255.01
6,241,091 B1 * 6/2001 Moore ..... A47B 81/02 206/349
6,393,626 B1 * 5/2002 Dhillon ..... E03C 1/308 4/255.01
6,519,785 B1 * 2/2003 Piercy, II ..... E03D 9/00 4/255.05
6,684,417 B1 * 2/2004 Schneider ..... E03C 1/308 4/255.05
6,859,949 B1 * 3/2005 Gavin ..... E03D 9/00 4/255.05
7,013,499 B2 * 3/2006 Tash ..... E03C 1/30 4/255.11
7,062,800 B1 * 6/2006 Alfred ..... E03D 9/00 4/255.01
2,711,234 A1 11/2008 Okada
8,245,329 B2 * 8/2012 Stein ..... E03C 1/308 4/255.11
8,307,468 B2 * 11/2012 Stein ..... E03C 1/308 4/255.11
D688,840 S * 8/2013 Wu ..... E03C 1/308 D32/14
8,544,122 B2 * 10/2013 Slot ..... E03D 9/00 4/255.05
8,550,080 B2 * 10/2013 McGinnis ..... A61M 16/06 128/206.24
D722,210 S * 2/2015 Gwen ..... E03D 9/00 D32/14
D749,280 S * 2/2016 Bailey ..... E03D 9/00 D32/15
2013/0139309 A1 * 6/2013 Bleecher ..... E03C 1/308 4/255.11

* cited by examiner

PLUNGER FOR PLUMBING FIXTURES

CROSS REFERENCE TO RELATED APPLICATIONS

This Utility Patent application claims the benefit of earlier filed U.S. Provisional Patent Application No. 62/146,540 filed on Apr. 13, 2015 for the same invention by the same inventor. The entire contents of the above identified earlier filed U.S. Provisional Patent Application No. 62/146,540 is expressly incorporated herein by this reference, and this incorporation reference is similarly made in the accompanying filed Application Data Sheet.

TECHNICAL FIELD

This invention relates to an improved plunger for plumbing fixtures and more particularly to a plunger for use with newer style 1.6 gallons per flush toilets.

BACKGROUND OF THE INVENTION

Plungers are known in the prior art and are customarily used to unclog pipes and plumbing fixtures including, but not limited to toilets.

Pipes and plumbing fixtures, when they are clogged, are usually unclogged using a known plunger that is generally comprised of a circular deformable convexly shaped plunger cup mounted on an elongated handle. During the plunging operation, the circular plunger cup is positioned over the opening of the pipe or plumbing fixture while the plunger handle is reciprocated upwardly and downwardly. The reciprocal motion alternately contracts and enlarges an internal volume defined by the circular convex plunger cup and responsively creates an alternating pressure and suction force in interconnected pipes and plumbing fixtures to dislodge the obstruction clog.

Recently, toilets have been redesigned to conserve water. The newer toilets, as compared to older models, have a substantially reduced water flow (approximately 1.6 gallons per flush) and have a smaller waste drain passage than older toilets. Since the waste drain passages of the newer toilets are narrower, these toilets are more prone to clogging. Conventional plungers are typically too wide to fit into the narrow waste drain passages (also called a waste exit port) of these new toilets, and therefore are difficult to hold in the position for proper effect. Newer toilets also have a siphon jet that is positioned adjacent to the waste exit port opening so as to facilitate a siphon action in the toilet bowl to remove waste therefrom when the toilet is flushed. The siphon jet is a hole through which water from the toilet tank rushes into the toilet bowl to facilitate the siphon flushing. The siphon jet communicates with the toilet tank by means of channels defined in the toilet body.

Positioning a conventional circular shaped cup plunger over the waste exist port of newer toilets causes the plunger to also be placed over the siphon jet. As a result, when the plunger is reciprocally moved to create the alternating pressure and suction forces, those forces are also directed into the siphon jet and associated plumbing fixtures which reduces, perhaps substantially, the pressure and suction forces that are intended to be directed to the waste exit port to remove the clog or obstruction. Conventional plungers are therefore frequently unable to provide sufficient pressure and suction for the purpose of dislodging the obstruction or clog. Further still, conventional plungers are low pressure devices because of their inverted cup-like shape, and the fact the dimensionally largest portion of the plunger is the portion that delivers the pressure and suction to the plumbing fixture.

Another problem related to the configuration of the newer low volume toilets is the physical configuration of the waste exit port. In older models of toilets, the waste exist port was generally circular and concave and located centrally at the bottom of the toilet bowl. As noted previously, older toilets also did not have a siphon jet positioned proximate to the waste exit port. In the newer low volume flush toilets, the waste exit port is a rectilinear depression defined in the bottom of the toilet bowl and the waste drain passage is oriented angularly relative to the bottom of the toilet bowl rather than oriented horizontally and opening upwardly. This modified configuration has enhanced the efficiency of the newer low flow toilets, but has had a negative effect of making conventional plungers less effective at removing obstructions and clogs. It is also made the positioning of such conventional plungers difficult.

In addition to problems related to the newer toilet designs, there are two common problems that frequently occur during plunging operations which are related to the design of conventional toilet plungers. These are "splash back" and "spillover". The pressure and suction generated during plunging often causes water to spray out of any gaps between the plunger cup and interior bowl surface with great force, and then splash up and outside the toilet bowl onto the plunger operator and onto nearby surfaces. This phenomenon is common when conventional plungers having a circular convex cup design are used in the newer designs of toilets having generally rectilinear shaped waste exit port. Additionally, many times when a toilet is clogged, the water and sewage in the toilet tend to fill the toilets to the brim. Hence, when the toilet plunger head is inserted into the toilet, the displacement of the toilet plunger head causes the toilet water and sewage to spillover the sides of the toilet. This phenomenon is called "spillover".

In order to overcome the limitations of conventional toilet plungers, what is needed is a toilet plunger that can be used with the newer low flow toilets. This plunger should effectively plunge toilets that have a waste exit port that is difficult to access, including those where the waste exit port is generally rectilinear within the toilet bowl. However, this improved plunger should also be compatible with older toilet models. Furthermore, this plunger should minimize spillage and splash back problems during plunging operations. The plunger should also be simple, capable of being easily fabricated and used, be inexpensive and to be durable.

SUMMARY OF THE INVENTION

A first aspect of the present invention relates to a forcibly collapsible plunger comprising a resiliently deformable body having a closed top portion, and a lower portion defining a bottom orifice wherein the top portion of the body and the lower portion of the body are interconnected to one another along adjacent edge portions to define an interior cavity communicating with the bottom orifice and the top portion of the body defines a first cavity having a first volume and the lower portion of the body defines a second cavity having a second volume, and wherein the second volume is less than the first volume and a resiliently deformable exterior lip circumscribes the bottom orifice and bottom portion sidewalls extend generally upwardly and outwardly from the resiliently deformable exterior lip to interconnect with a bottom edge of the body top portion wherein the first cavity and the second cavity form the interior cavity and axial downward pressure exerted on the resiliently deformable body causes the top portion of the resiliently deformable body to be forcible collapsed downwardly into the second cavity which responsively forcibly expels contents of the interior cavity through the bottom orifice.

A second aspect of the present invention relates to a forcibly collapsible plunger wherein the open bottom orifice has the configuration of a substantially true arch.

A third aspect of the present invention relates to a forcibly collapsible plunger wherein the closed top portion and the bottom portion both have a horizontal cross-sectional configuration of a substantially true arch.

A fourth aspect of the present invention relates to a forcibly collapsible plunger wherein the body lower portion has a configuration of a rectilinear truncated conic.

A fifth aspect of the present invention relates to a forcibly collapsible plunger further comprising a handle interconnected with the top portion of the resiliently deformable body.

A sixth aspect of the present invention relates to a forcibly collapsible plunger wherein the handle attachment is axially aligned with a center line of the open bottom orifice to directionally control expelled contents of the interior cavity.

A seventh aspect of the present invention relates to a forcibly collapsible plunger for a toilet bowl comprising a flexible resiliently deformable body having a closed top portion carrying a handle attachment, and a truncated conic shaped lower portion defining an open bottom true arch orifice wherein the top portion of the body and the lower portion of the body are interconnected to one another along adjacent edge portions to define an interior cavity communicating with the open bottom true arch orifice and the top portion of the body has a convexly shaped closed upper surface and has a horizontal cross-sectional configuration of a substantially true arch defining a first cavity having a first volume and the lower portion of the body has a horizontal cross-sectional configuration of a substantially true arch defining a second cavity having a second volume, and wherein the second volume is less than the first volume and the open bottom true arch orifice is circumscribed by a flexible resiliently deformable exterior lip and angulated sidewalls extend generally upwardly and outwardly from the flexible resiliently deformable exterior lip to interconnect with a bottom edge of the body top portion wherein the first cavity and the second cavity communicate to form the body interior cavity and axial downward pressure exerted on the resiliently deformable body through the handle attachment causes the top portion of the resiliently deformable body to be forcible collapsed downwardly into the second cavity which responsively forcibly and directionally expels contents of the interior cavity through the open bottom true arch orifice.

DETAILED DESCRIPTION OF THE PREFERRED EMBODIMENTS

Figure 1:
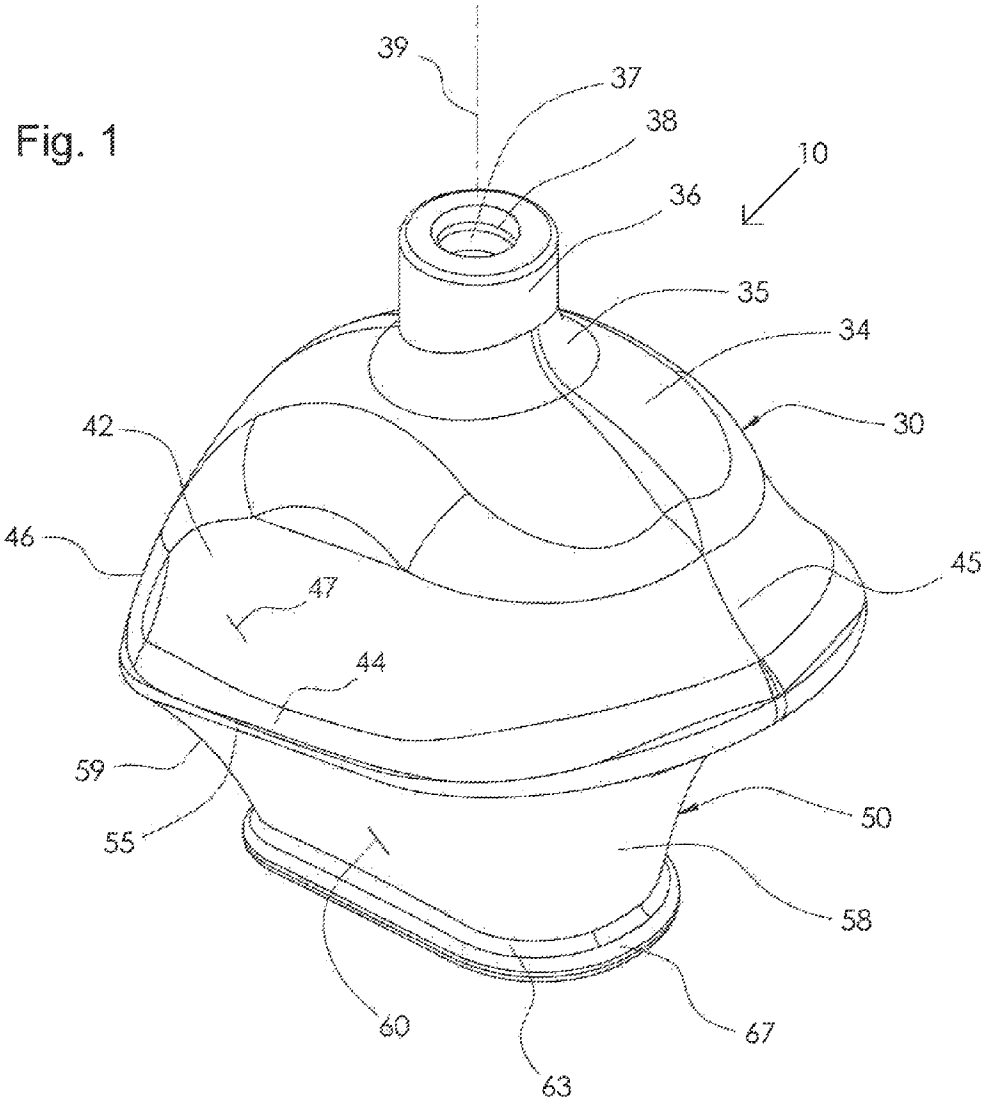
FIG. 1 is an isometric front, top and first side view of the improved plunger.
Figure 2:
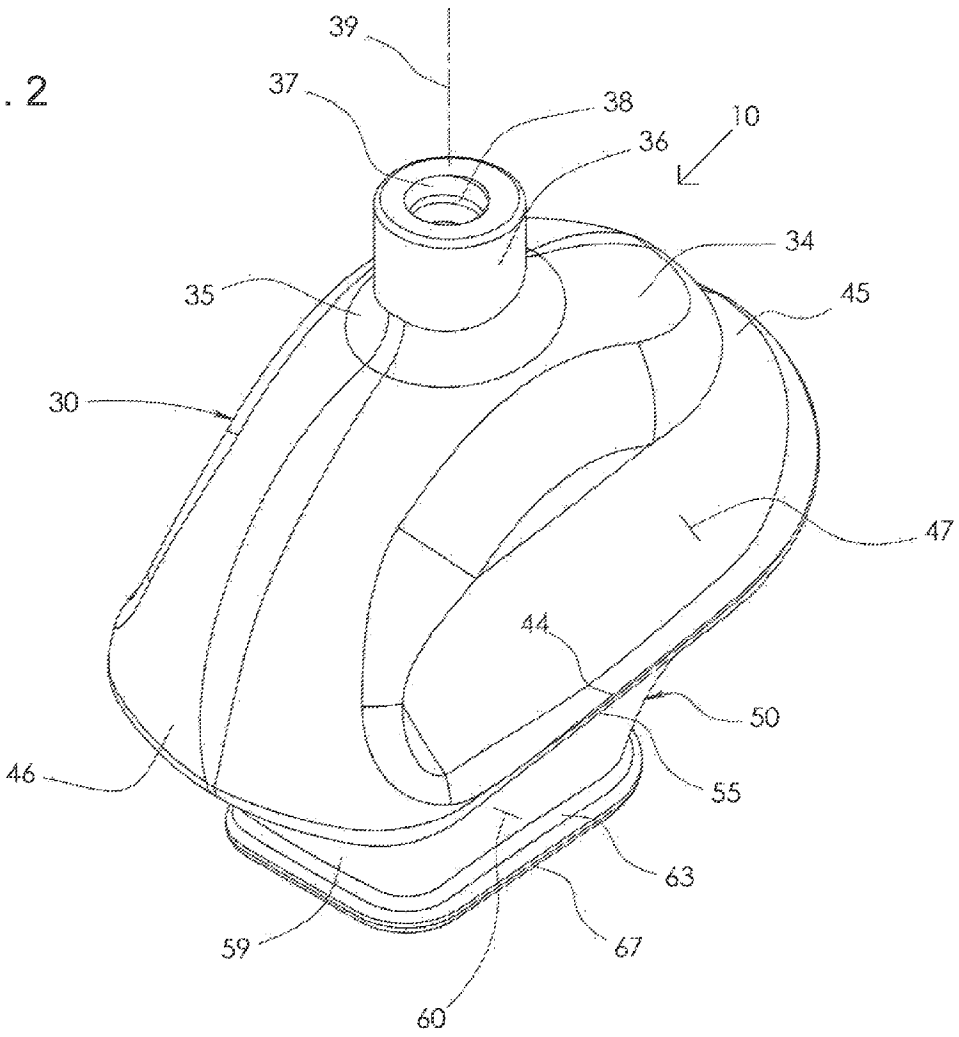
FIG. 2 is an isometric rear, op and first side view thereof.
Figure 3:
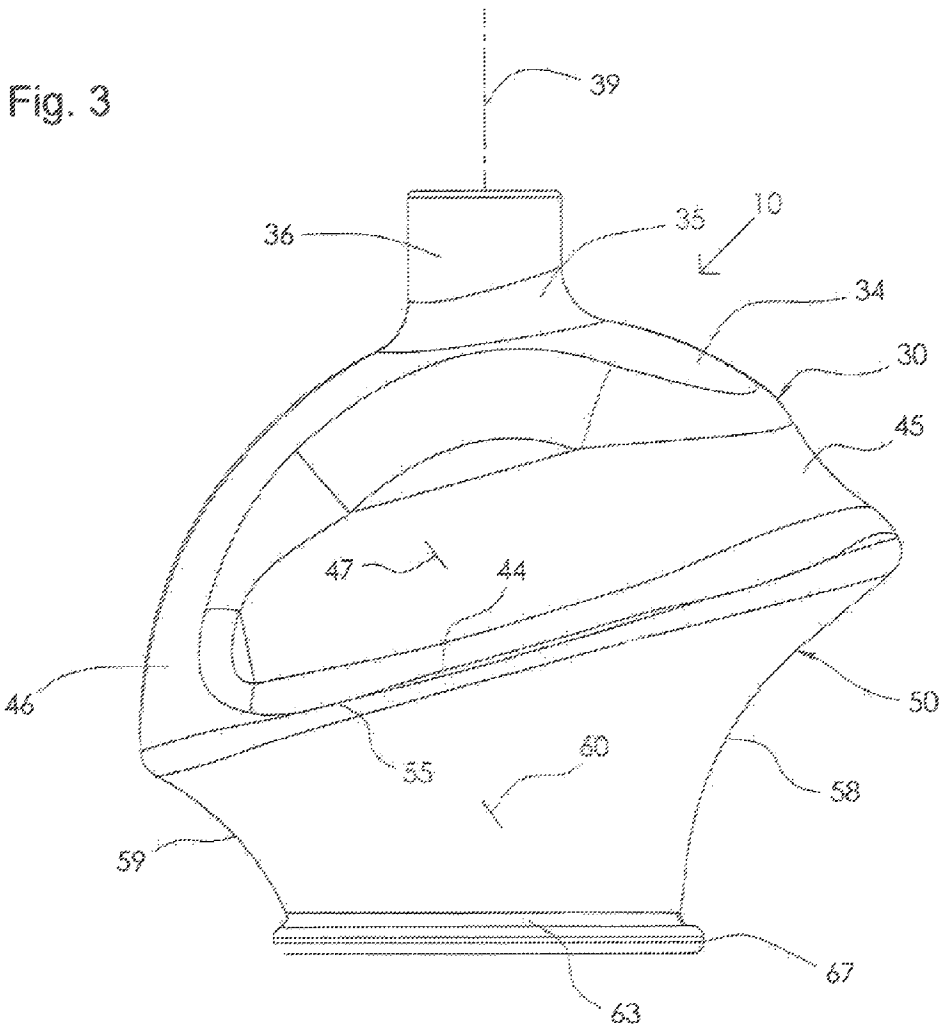
FIG. 3 is an orthographic first side view thereof.
Figure 4:
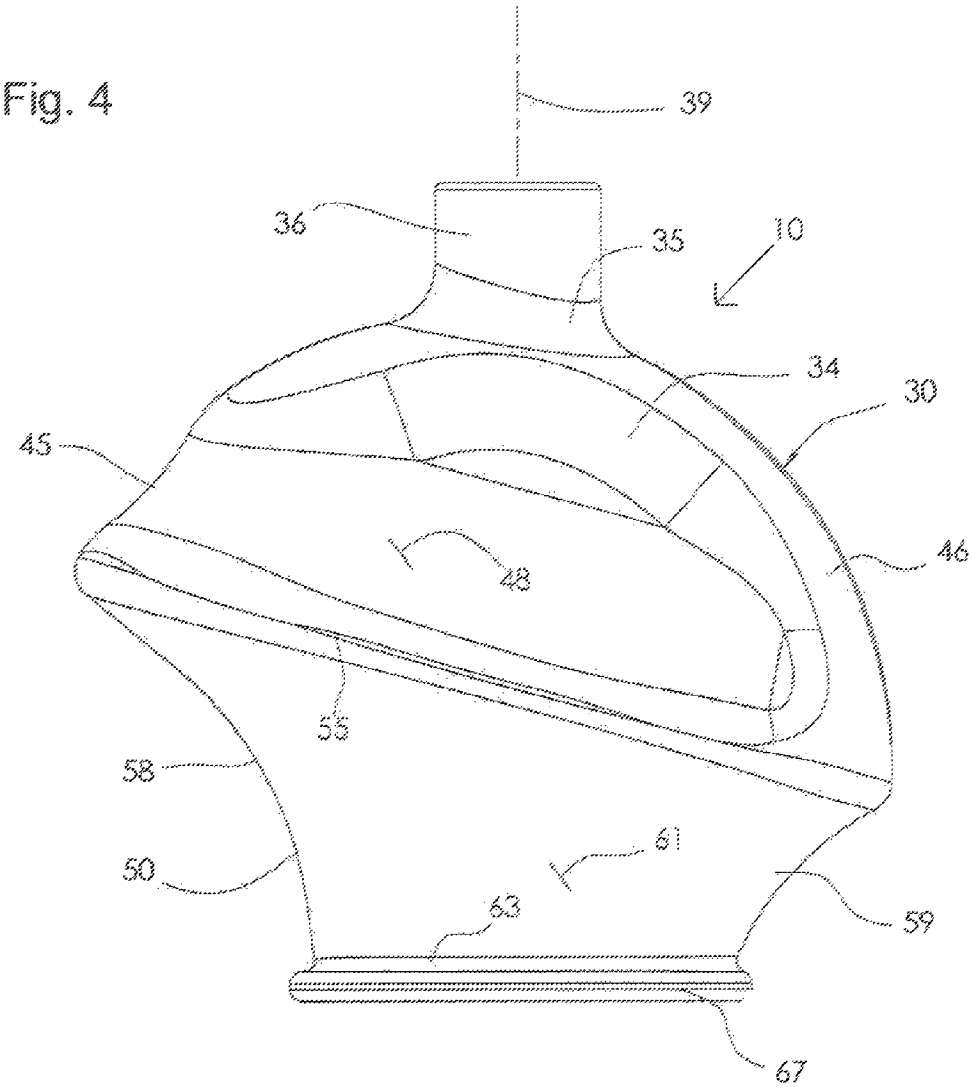
FIG. 4 is an orthographic second side view thereof.
Figure 5:
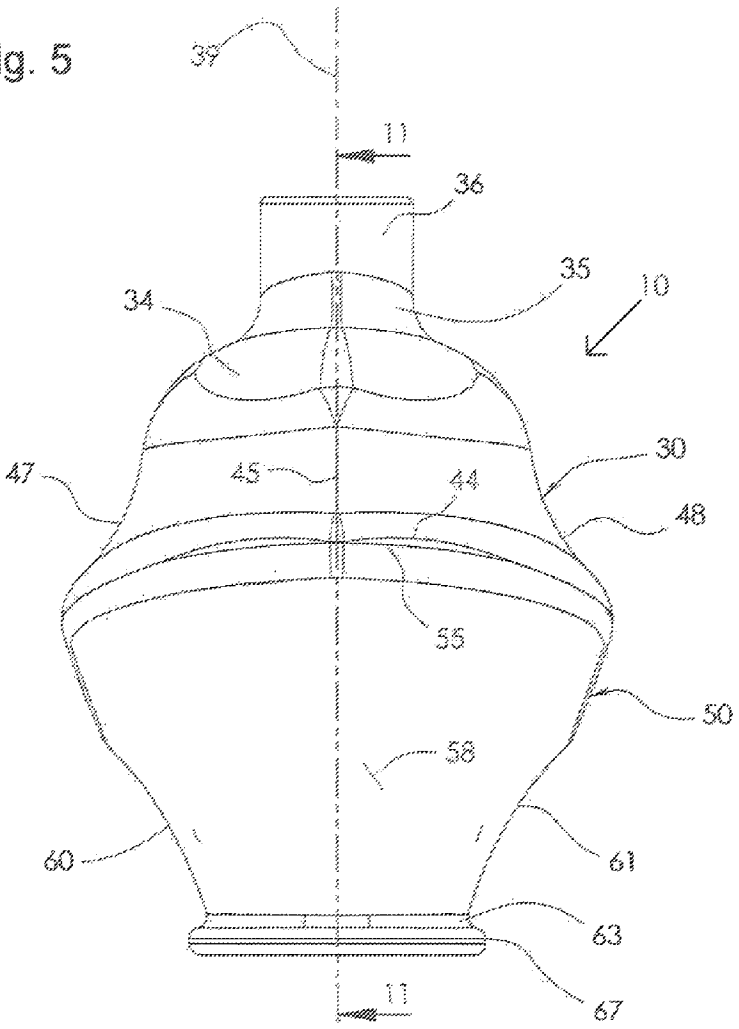
FIG. 5 is an orthographic front view thereof.
Figure 6:
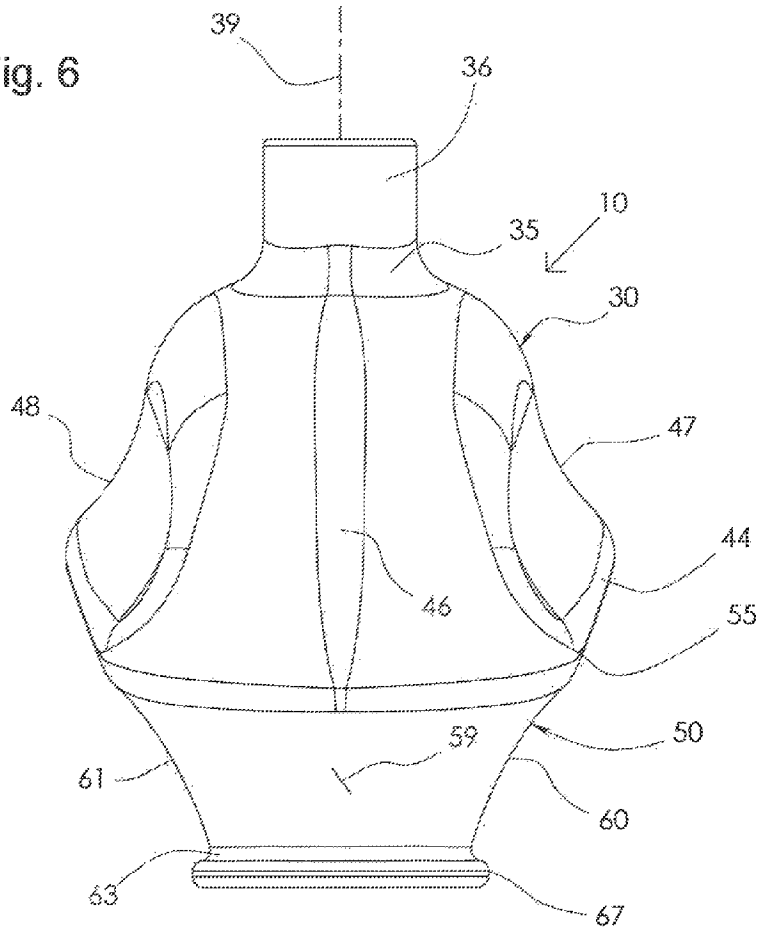
FIG. 6 is an orthographic rear view thereof.
Figure 7:
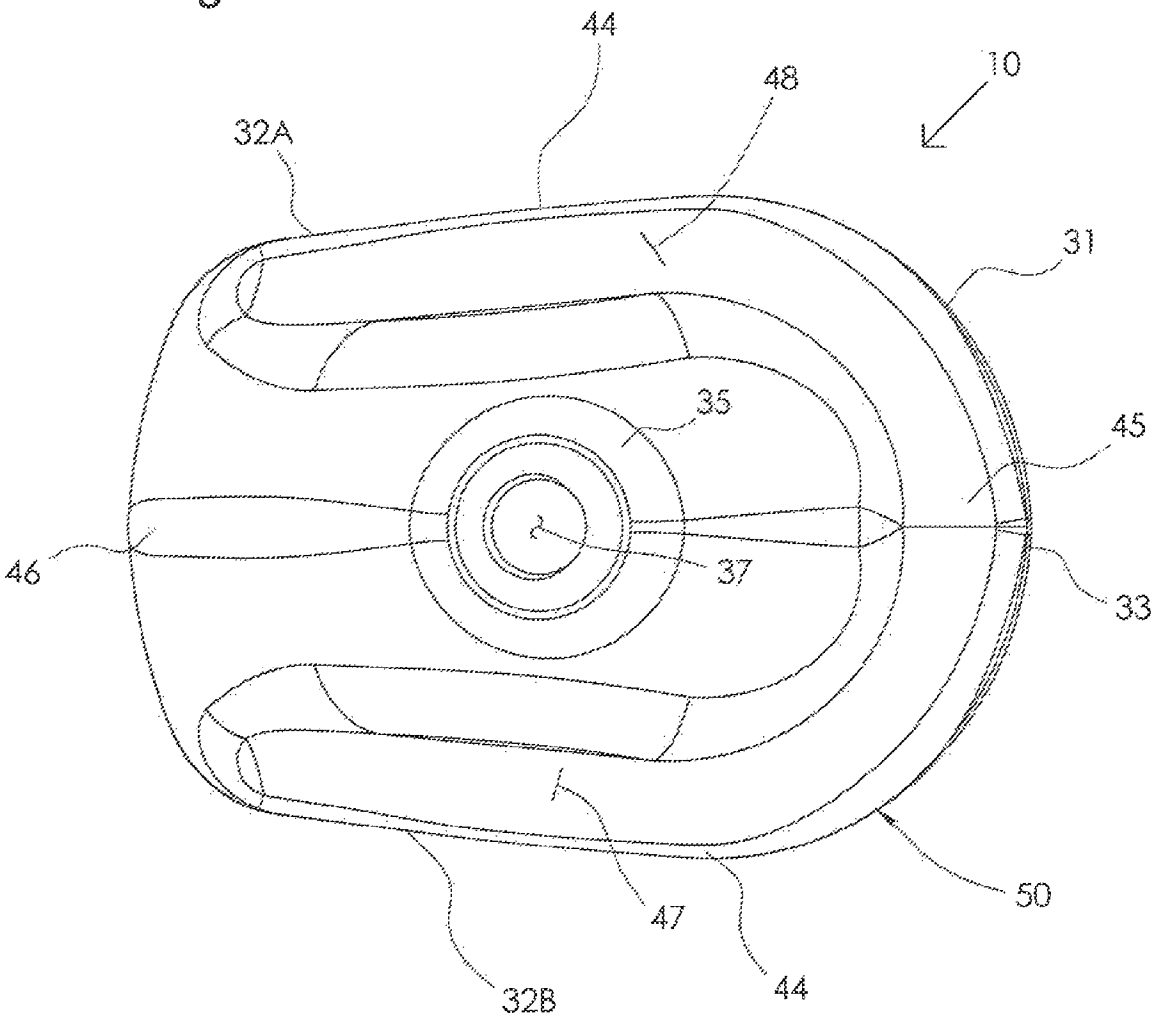
FIG. 7 is an orthographic top, downward looking view thereof.

This disclosure of the invention is submitted in furtherance of the Constitutional purposes of the U.S. Patent Laws "to promote the progress of science and useful arts" (Article 1, Section 8).

An improved plunger for toilets, pipes and plumbing fixtures generally provides a resiliently deformable body 10 having a closed top portion 30 and an integrally attached lower portion 50. The body 10 has an external surface 11 that extends over and about the closed top portion 30 and the lower portion 50 and defines an interior cavity 13 having an interior surface 12 and defining a volume.

As shown in the Figures, the body 10 has a configuration (in a plan view) commonly termed a "true arch" having an arch arc 33 at a front portion 45, and two spaced apart somewhat parallel legs 32A, 32B extending from the arc 33 along opposing side portions 48, 47 of the body 10.

The closed top portion 30 has a peripheral configuration of a generally convex dome 34 with a handle attachment 35 on an upper exterior surface 11. The convex dome 34 curves generally outwardly and downwardly to form the front portion 45, an opposed rear portion 46, a first side portion 47 and a second side portion 48. The closed top portion 30 terminates at a bottom edge 44, opposite the handle attachment 35. The bottom edge 44 circumscribes a first interior cavity 40 defined by the closed top portion 30.

The handle attachment 35 structurally communicates with the convex dome 34 exterior surface 11 and forms an annulus 36 at an upper end portion thereof. The annulus 36 defines a medial cavity 37 that defines internal threads 38 for releasable engagement with an elongate handle 80. The handle attachment 35 further defines an axis 39 that extends through the handle attachment cavity 37 and the interior cavity 13 defined by the body 10. (See FIG. 11).

Figure 11:
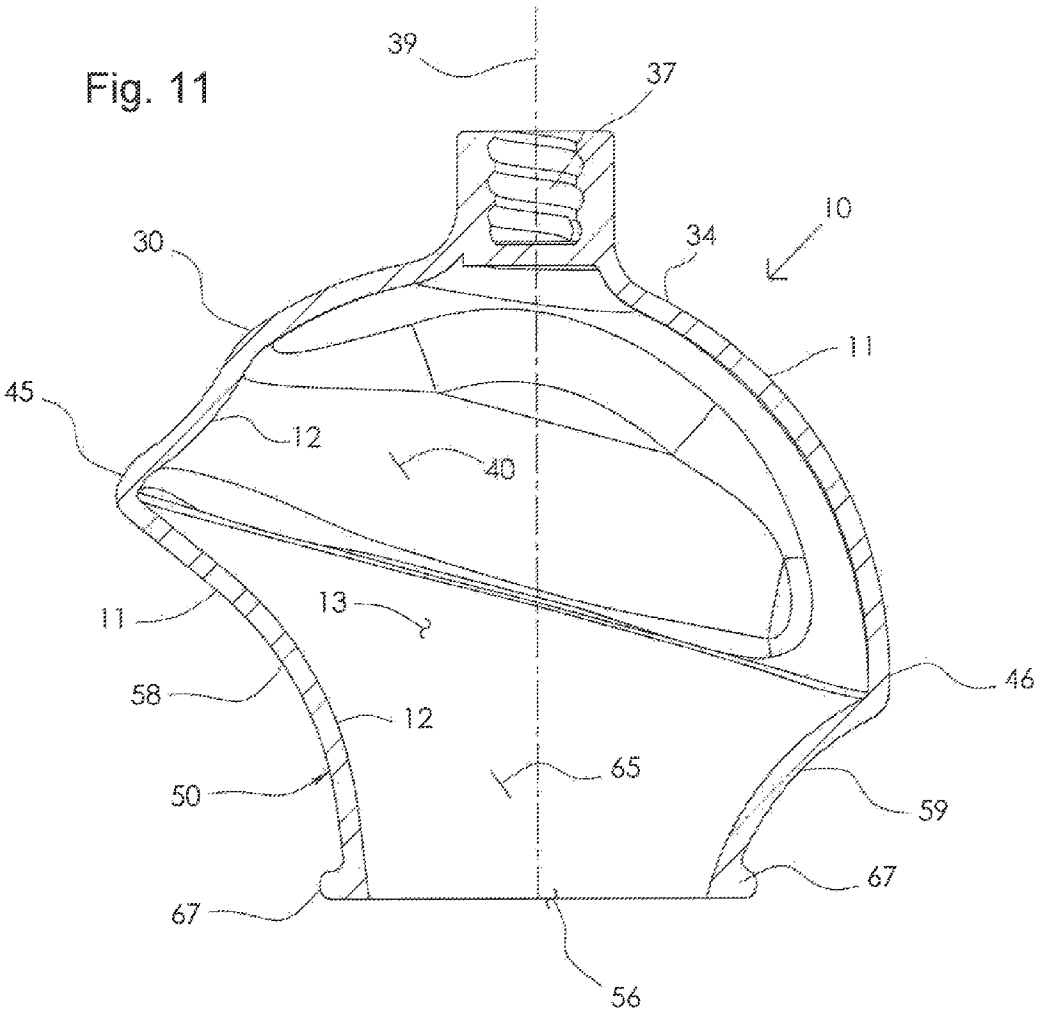
FIG. 11 is an orthographic cross section of the improved plunger taken on line 11-11 of FIG. 5, showing the first interior cavity and the second interior cavity which together form the improved plunger's interior cavity communicating with the bottom orifice.

As shown in FIG. 11, the first interior cavity 40 is defined by an interior surface 43 of the closed top portion 30 and the first interior cavity 40 defines a first volume.

Figure 8:
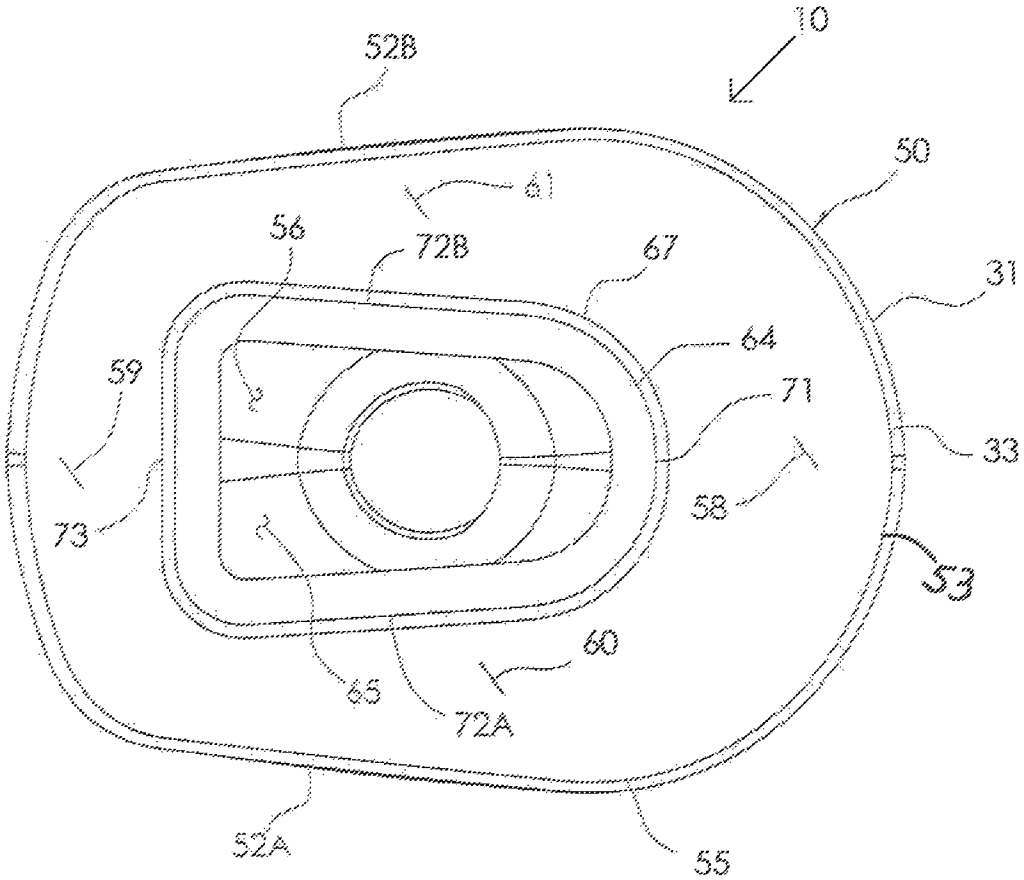
FIG. 8 is an orthographic bottom, upward looking view thereof, showing the bottom orifice and the interior cavity.
Figure 9:
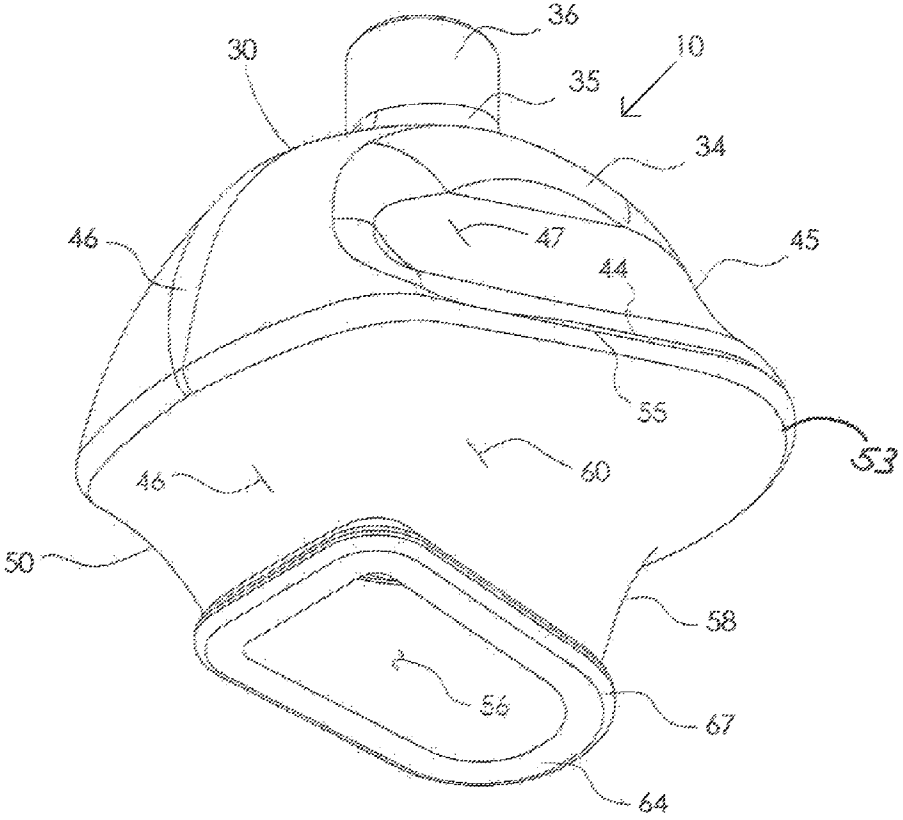
FIG. 9 is an isometric rear, bottom and first side view thereof, showing the bottom orifice and resiliently deformable lip extending thereabout.
Figure 10:
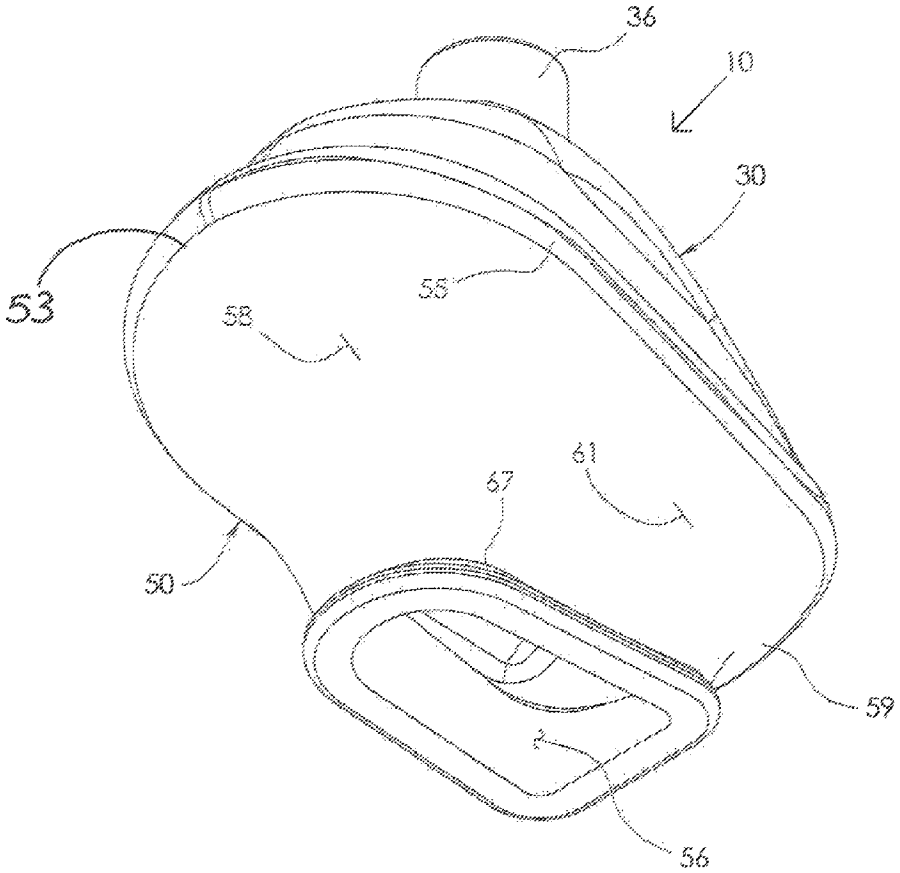
FIG. 10 is an isometric front, bottom and second side view of the improved plunger showing the bottom orifice and entry to the interior chamber.

The lower portion 50 of the body 10 similarly has a true arch configuration (in a plan view) (see FIG. 8) which has an arc 53 adjacent a front wall 58, and two spaced apart somewhat parallel legs 52A, 52B that communicate with opposing end portions of the arc 53 and extend rearwardly therefrom.

As shown in FIGS. 3-6, the lower portion 50 of the body 10 has a generally rectilinear truncated conical shape 54 having an upper edge portion 55, a front wall 58, a rear wall 59, a first sidewall 60, a second sidewall 61 and a bottom edge 63 circumscribing a bottom orifice 56 defined by the lower portion 50. A circumferentially extending edge 64 of the bottom orifice 56 carries an outwardly extending flexible resiliently deformable exterior lip 67. The lower portion 50 of the body 10 similarly has an exterior surface 11 and an interior surface 12 (FIG. 11) and defines a second interior cavity 65 having a second volume, and the second volume is less than the first volume. The truncated conical shape forms a "funnel" along interior surface 12 which assists in directionally controlling and accelerating the expelled contents when the body 10 is forcefully collapsed to expel contents of the interior cavity 13.

The bottom orifice 56 similarly has a true arch configuration having an arc 71 at a position proximate the front wall 58, and has two spaced apart generally parallel legs 72A, 72B, that extend rearwardly from the are 71. A resiliently deformable exterior lip 67 circumscribes an exterior edge of the bottom orifice 56 extending about the arc 71 and the legs 72A, 72B and across a base portion 73 that extends between the legs 72A, 72B opposite the arc 71. The resiliently deformable exterior lip 67 provides a flexible seal extending circumferentially about the bottom orifice 56 and provides some rigidity to the lower portion 50 to facilitate engagement with the plumbing fixture, to provide a better seal therewith, and to provide directional control to the expelled contents of the interior cavity 13. The bottom orifice 56 is dimensionally smaller than the body 10 and the smaller size of the bottom orifice 66 creates a nozzle through which contents of the interior cavity 13 are expelled. The smaller dimensions of the bottom orifice 56 causes the volume of contents of the body 10 to be accelerated through the dimensionally smaller bottom orifice 56 which increases pressure and suction that is applied to the plumbing fixtures to remove the clog or obstruction therein.

The upper edge 55 of the lower body portion 50 is interconnected with the bottom edge 44 of the closed top portion 30. The interconnection of the upper edge 55 and the bottom edge 44 forms a fluid tight seal therebetween. In the preferred embodiment, the resiliently deformable body 10 is formed unitarily in a mold such that there is no seam between the closed top portion 30 and the lower portion 50.

As shown in FIG. 11, axis 39 is oriented to pass through a middle portion of the first interior cavity 40 and a middle portion of the second interior cavity 65 so that when axial downward pressure is exerted upon the body 10 by a user exerting force on handle 80, the convex dome upper surface 34 of the closed top portion 30 is displaced downwardly into the first interior cavity 40 which responsively reduces the first volume of the first interior cavity 40. Further downward axial pressure upon the handle 80 forces the interior surface 12 of the convex dome upper surface 34 downwardly into the second interior cavity 65 which similarly reduces the second volume. The downward displacement of the convex dome upper surface 34 and the resulting collapsing of the interior cavity 13 reducing the first volume and the second volume forcefully expels the contents of the interior cavity 13 (which may be fluidic, or gaseous) directionally outwardly through the bottom orifice 56.

Figure 12:
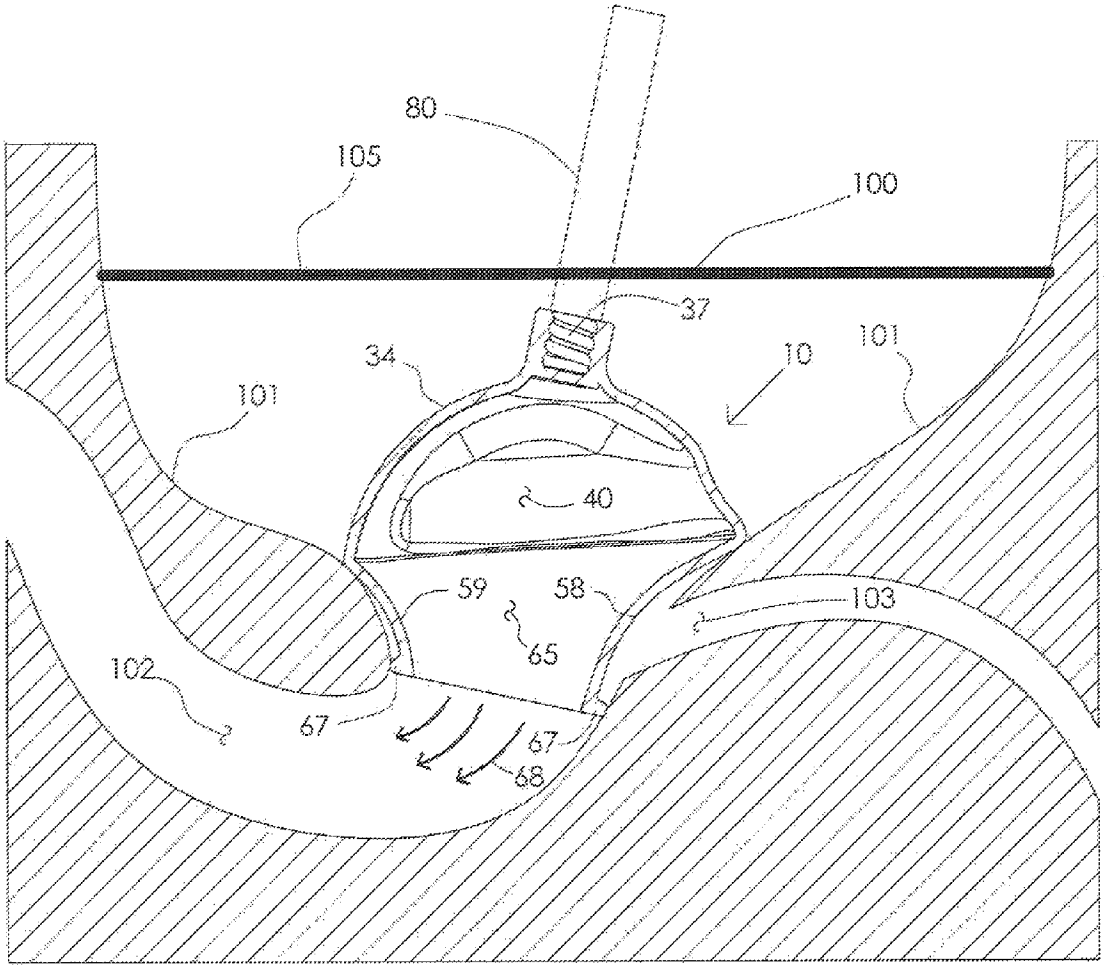
FIG. 12 is an environmental view of the improved plunger positioned within a toilet bowl with the lower portion of the body engaged within the waste exit port and sealing the siphon jet below the fluid level.

As shown in FIG. 12, toilet bowl 100 has an interior surface 101, defining a waste exit port 102 and a siphon jet 103. The toilet bowl 100 further has a fluid level 105 that is generally vertically above the waste exit port 102 and above the siphon jet 103. Pipes and plumbing fixtures (not shown) communicate with the waste exit port 102 to receive fluids and waste from the toilet bowl 100. As shown in FIG. 12, when the body 10 is placed within the toilet bowl 100, the truncated conical shape 54 of the lower portion 50 generally fits into the generally rectilinear waste exit port 102 such that the resiliently deformable exterior lip 67 frictionally engages with the interior surfaces of the toilet bowl 101. The front wall 58 of the lower portion 50 is positioned adjacent to the siphon jet 103 so that compression (collapse) of the body 10 cannot direct the contents of the interior cavity 13 into the siphon jet 103 which would reduce the efficiency and effectiveness of the improved plunger. Instead, the entire contents of the interior cavity 13 is forcefully and directionally expelled from the interior cavity 13 and is directed into the waste exit port 102 and into interconnected pipes and plumbing fixtures. The resiliently deformable exterior lip 67 provides a seal between the lower portion 50 bottom orifice 56 and the interior surfaces 101 of the toilet bowl and directs the expulsion of contents of the interior cavity 13 directly into the waste exit port 102 to remove clogs and obstructions in the pipes and plumbing fittings (not shown). The somewhat rectilinear truncated conic shape of the lower portion 50 provides for secure engagement with the waste exit port 102 and reduces the likelihood of "splashback".

Operation

Operation of the described embodiments of the present invention are believed to be readily apparent and are briefly summarized at this point. In its broadest aspect, the present invention comprises a flexible resiliently deformable plunger body 10 having a closed top portion 30 carrying a handle attachment 35, and a generally rectilinear truncated conic shaped lower portion 50 defining an open bottom true arch orifice 56. The top portion 30 of the body 10 and the lower portion 50 of the body 10 are interconnected to one another along adjacent edge portions 44, 55 to define an interior cavity 13 communicating with the open bottom true arch orifice 56. The top portion 30 of the body 10 has a domed convexly shaped closed upper surface 34 and has a planar cross-sectional configuration of a substantially true arch defining a first interior cavity 40 having a first volume. The lower portion 50 of the body 10 similarly has a planar cross-sectional configuration of a substantially true arch defining a second interior cavity 65 having a second volume, and wherein the second volume is less than the first volume. The open bottom orifice 56 is circumscribed by a flexible resiliently deformable exterior lip 67 and angulated sidewalls 58, 59, 60, 61 extend generally upwardly and outwardly from the flexible resiliently deformable exterior lip 67 to interconnect with a bottom edge 44 of the body 10 top portion 30 wherein the first cavity 40 and the second cavity 65 communicate to form the body interior cavity 13 so that axial downward pressure exerted on the resiliently deformable body 10 by means of a handle 80 interconnected with the handle attachment 35 causes the top portion 30 of the resiliently deformable body 10 to be forcible collapsed downwardly into the second cavity 65 which responsively forcibly and directionally expels contents of the interior cavity 13 through the open bottom orifice 56.

Placement of the body 10 within a toilet bowl 100 so that the lower portion 50 of the body 10 fits into and is engaged with the waste exit port 102 of the toilet bowl 100 below the fluid level 105 and the resiliently deformable exterior lip 67 is in frictional contact with the interior surfaces 101 of the toilet bowl vertically below the siphon jet 103 so as to seal the siphon jet 103 from pressure and suction forces generated by the reciprocal compression and expansion of the body 10. Once the resiliently deformable body 10 is engaged with the waste exit port 102, the handle 80 is used to reciprocally exert downward and upward pressure on the body 10 which responsively causes the body 10 to collapse downwardly/inwardly upon itself and responsively expel the contents of the interior cavity 13 forcefully and directionally outwardly through the bottom orifice 56 wherein the expelled contents of the cavity 13 is directed into the waste exit port 102 of the toilet bowl 100 and associated plumbing pipes and fixtures (not shown) so as to remove obstructions and clogs thereof.

Therefore, it will be seen that the present invention provides a convenient and effective means whereby clogs and obstructions in toilets, pipes and plumbing fixtures may be removed.

In compliance with the statute, the invention has been described in language more or less specific as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalents.

I claim:

1. A plunger for a low volume toilet defining a true arch shaped drain depression in a bottom of the toilet bowl, the drain depression defining a siphon jet and a separate waste exit port spaced apart from the siphon jet, the plunger comprising:

a resiliently deformable body having a convexly dome shaped closed top portion, and a lower portion defining an open bottom orifice opposite the convexly dome shaped closed top portion, and wherein the convexly dome shaped closed top portion, the lower portion and the open bottom orifice all have a peripheral configuration of a true arch, and wherein each true arch has an arc at one end portion and a leg extending linearly from each opposing end of the arc to a linear base portion opposite and spaced apart from the arc;

the convexly dome shaped closed top portion of the body defines a first cavity having a first volume;

the lower portion of the body defines a second cavity having a second volume, and wherein the second volume is less than the first volume;

a resiliently deformable exterior lip circumscribes the open bottom orifice, and bottom portion sidewalls extend upwardly and angularly outwardly from the resiliently deformable exterior lip to interconnect with a bottom edge of the convexly dome shaped-closed top portion in a fluid-tight connection and wherein the first cavity and the second cavity in combination form an interior cavity that communicates with the open bottom orifice; and downward pressure exerted on the convexly dome shaped closed top portion by use of an elongate handle interconnected with the convexly dome shaped closed top portion causes the convexly dome shaped closed top portion to collapse downwardly into the second cavity defined by the lower portion which responsively forcibly expels contents of the interior cavity outwardly through the open bottom orifice.

2. The plunger of claim 1 and wherein the true arch configuration of the resiliently deformable body sealingly engages within the true arch shaped drain depression in the toilet bowl bottom and wherein the angulated sidewalk that extend upwardly and laterally outwardly from the resiliently deformable lip to interconnect with the bottom edge of the closed top portion obstruct and seal off the siphon port while positioning the open bottom orifice to sealingly engage with the waste exit port so that the expelled contents of the interior cavity is directed solely into the waste exit port.

3. A plunger for a low volume toilet defining a true arch shaped drain depression in a bottom of the toilet bowl, the drain depression defining a siphon jet and a separate waste exit port spaced apart from the siphon jet, the plunger comprising:

a resiliently deformable body having a convexly dome shaped closed top portion carrying a handle attachment, and a truncated conic shaped lower portion defining an open bottom orifice opposite the handle attachment, and wherein the closed top portion, the truncated conic lower portion, and the bottom orifice all have a peripheral configuration of a true arch, and each true arch has an arc at one end portion and a leg extending linearly from each opposing end of the arc to a linear base portion spaced apart from and opposite the arc;

the top portion of the body and the lower portion of the body are interconnected to one another along adjacent edge portions to define an interior cavity communicating with the open bottom orifice;

the closed top portion defines a first cavity having a first volume;

the lower portion of the body defines a second cavity having a second volume, and the second volume is less than the first volume;

the open bottom orifice is circumscribed by a resiliently deformable exterior lip and angulated sidewalls extend upwardly and laterally outwardly from the resiliently deformable exterior lip to interconnect with a bottom edge of the closed top portion wherein the first cavity and the second cavity communicate to form the interior cavity;

axial downward pressure exerted on the closed top portion by use of a handle interconnected to the handle attachment causes the closed top portion to forcibly collapse downwardly into the second cavity which responsively forcibly and directionally expels contents of the interior cavity through the open bottom orifice; and and wherein the true arch configuration of the resiliently deformable body sealingly engages within the true arch shaped drain depression in the toilet bowl bottom and wherein the angulated sidewalls that extend upwardly and laterally outwardly from the resiliently deformable hp to interconnect with the bottom edge of the closed top portion obstruct and seal off the siphon port while positioning the open bottom orifice to sealingly engage with the waste exit port so that the expelled contents of the interior cavity is directed solely into the waste exit port.

* * * * *